US005393078A

United States Patent [19]

Bourdeau

[11] Patent Number: 5,393,078

[45] Date of Patent: Feb. 28, 1995

[54] SKATE WITH IN-LINE WHEELS

[75] Inventor: Joël Bourdeau, Saint-Jorioz, France

[73] Assignee: Salomon S.A., Metz-Tessy, France

[21] Appl. No.: 70,166

[22] Filed: Jun. 2, 1993

[30] Foreign Application Priority Data

Jun. 9, 1992 [FR] France ..... 92 07148

[51] Int. Cl.[6] ..... A63C 17/06; A63C 17/22

[52] U.S. Cl. ..... 280/11.22; 152/17; 280/11.28; 301/1; 301/5.3; 301/105.1; 301/124.1

[58] Field of Search ..... 152/17, 40, 69, 75, 152/80; 301/1, 5.1, 5.3, 5.7, 36.2, 124.1, 105.1; 280/11.22, 11.28

[56] References Cited

U.S. PATENT DOCUMENTS

| | | | |
|---|---|---|---|
| 1,134,011 | 3/1915 | Retzlaff | 152/80 X |
| 1,158,422 | 11/1915 | Alton | 152/80 |
| 1,442,897 | 1/1923 | Murry | 152/69 X |
| 1,639,827 | 8/1927 | Wayne | 152/40 X |
| 1,878,330 | 9/1932 | Sauer | 152/40 |
| 1,983,869 | 12/1934 | Nichol | 301/5.7 X |
| 3,389,922 | 6/1968 | Eastin | 280/11.28 X |
| 4,541,643 | 9/1985 | Pavincic | 280/11.21 |
| 5,199,727 | 4/1993 | Lai | 301/5.3 X |

FOREIGN PATENT DOCUMENTS

| | | |
|---|---|---|
| 2132471 | 11/1972 | France . |
| 2614474 | 10/1977 | Germany . |

*Primary Examiner*—Karin L. Tyson
*Assistant Examiner*—Michael Mar
*Attorney, Agent, or Firm*—Sandler Greenblum & Bernstein

[57] ABSTRACT

A skate including a chassis formed by an upper horizontal plate solidly joined to the sole of a shoe by fasteners and a lower part running perpendicular to the plate and including at least one lateral flange on which the wheels are disposed by transverse axles solidly joined to the chassis, constituting a rolling train, each of the wheels having a hub in fixed rotation, which is disposed on the axle and which supports a bearing interpolated between the hub and a tire. The hub of the wheel is equipped with an arrangement which allows for its angular deflection relative to its median horizontal plane. The arrangement for angular deflection includes the transverse axle which is horizontally off-center in relation to the virtual center of the wheel which can cooperate by abutment with a fixed axle solidly joined to the chassis which passes through it, and which supports an elastic recoil device.

24 Claims, 3 Drawing Sheets

SKATE WITH IN-LINE WHEELS

BACKGROUND OF THE INVENTION

1. Field of the Invention

The present invention relates to a skate with in-line wheels the usage of which is related to the technique of ice skating.

2. Discussion of Background and Relevant Information

The aforementioned type of skate is intended for training ice skaters outside the skating rink, as well as for all athletic people desiring to maintain or perfect the techniques used in gliding sports such as downhill skiing, cross-country skiing, ice skating, etc., on a hard surface of asphalt, cement, etc.

Just as in those sports, the practice of this sport consists of a motive or propulsive phase in which the skate is pushed toward the outside and the consequently inclining wheels are leaned upon, analogously to digging in the edges of an ice-skate blade, then a gliding phase, executed by repositioning the wheels perpendicular to the ground.

In this same technique of skating on in-line wheels, braking is accomplished by lateral drag of the inclined wheels or conversely by opposition.

Turns are also executed by leaning laterally on the wheels.

As mentioned above, this sport is practiced on asphalt surfaces, cement, or other hard surfaces which are generally composed of rough materials such as gravel, small pebbles, or even small but genuine obstacles such as repaired patches, paving stones, seams, etc.

Of course, these constitute an impediment to the smooth flow of skating, because they cause vibrations which make the practice of this sport uncomfortable.

Consequently, this accentuates fatigue, thus diminishing performance, especially since steering precision is also affected.

It is known to overcome these drawbacks by providing means of damping, i.e., shock absorption.

This can be a matter of inserting a layer of rubber between the shoe and the plate of the chassis, for example, but in that case comfort is obtained at the expense of precision and steering.

It can also be a matter of inserting a shock-absorbing sole into the shoe, but as in the previous solution, skating precision is affected. Moreover, this entails a variation in the volume that determines how the shoe fits, depending on the compressibility of the material constituting the sole. The result is a compromise between comfort and precision that cannot both be preserved at the same time.

Another known shock absorption technique makes use of an axle of the wheel which is supported by two more or less flexible rings, but performance suffers as a result of this, because the available volume of currently used bearings does not allow adjustment of the guidance of the wheels.

Moreover, using such means creates a floating effect in the wheel which is detrimental to the proper handling of the skate.

SUMMARY OF THE INVENTION

An object of the present invention is to overcome the aforementioned drawbacks, and to that end relates to the type of skate with in-line wheels including a chassis formed by an upper horizontal plate made solid with a sole of a shoe by fasteners and by a lower part running perpendicular to the plate along its longitudinal axis which includes at least one lateral flange on which a number of wheels are disposed by means of transverse axles solidly joined to the chassis, thus constituting a rolling train, wherein each of the wheels comprises a hub in fixed rotation disposed on the axle, to which is mounted a ball bearing inserted between the hub and an elastic envelope constituting a tire, and wherein the hub of the wheel is equipped with means which allow for its angular deflection relative to its median horizontal plane, along a predetermined angle and counter to an elastic recoil device, so as to constitute a vibration-absorbing device, interpolated between the tire of the wheel and the chassis of the skate.

BRIEF DESCRIPTION OF THE DRAWINGS

The invention will be better understood and its other characteristics will become evident with the help of the ensuing description in conjunction with the appended schematic drawings, which by way of non-limiting example illustrate how the invention can be executed, and in which.

DETAILED DESCRIPTION OF THE PREFERRED EMBODIMENTS

Figure 1:
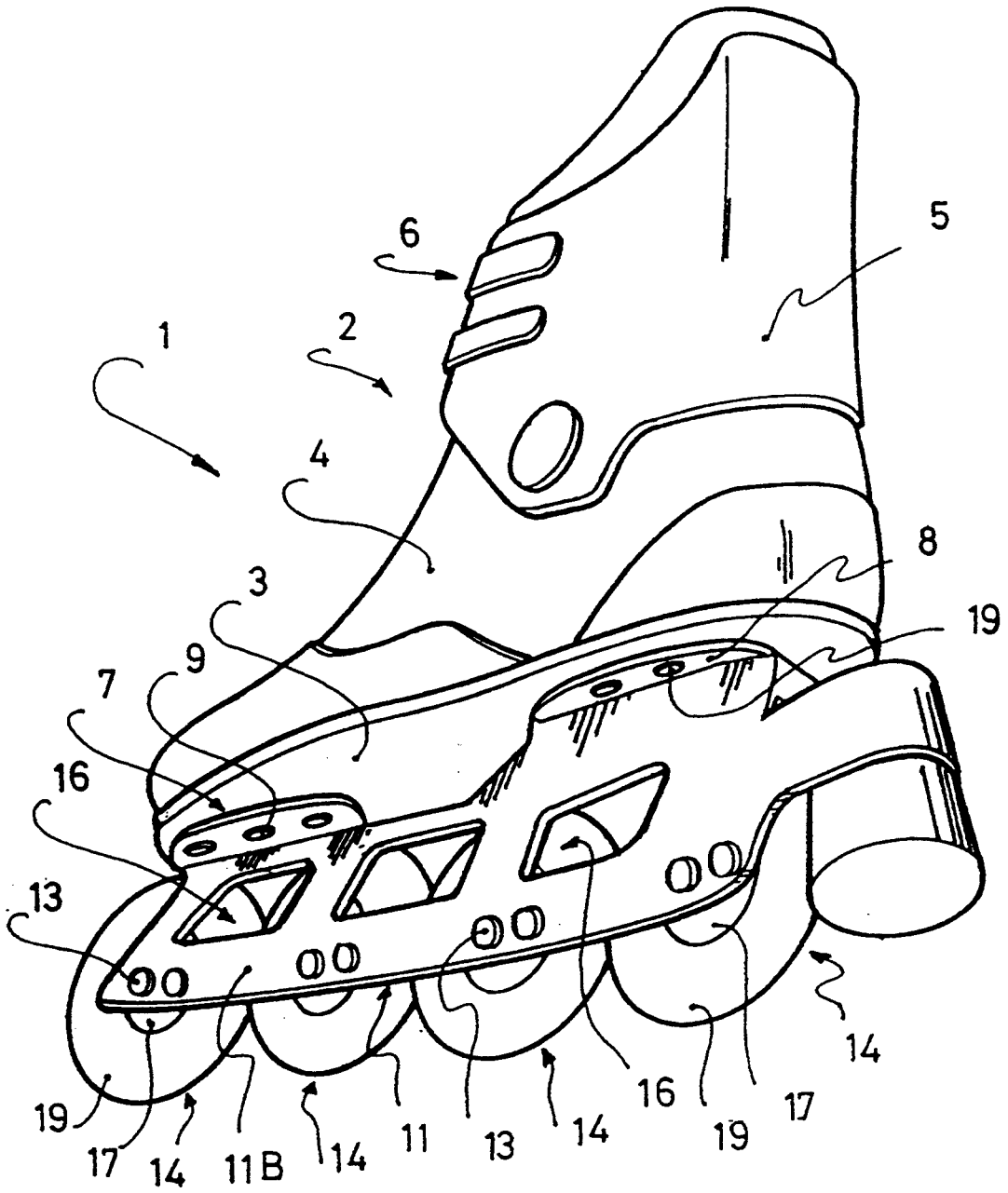
FIG. 1 is a view in perspective of a skate with in-line wheels and its attached shoe.
Figure 2:
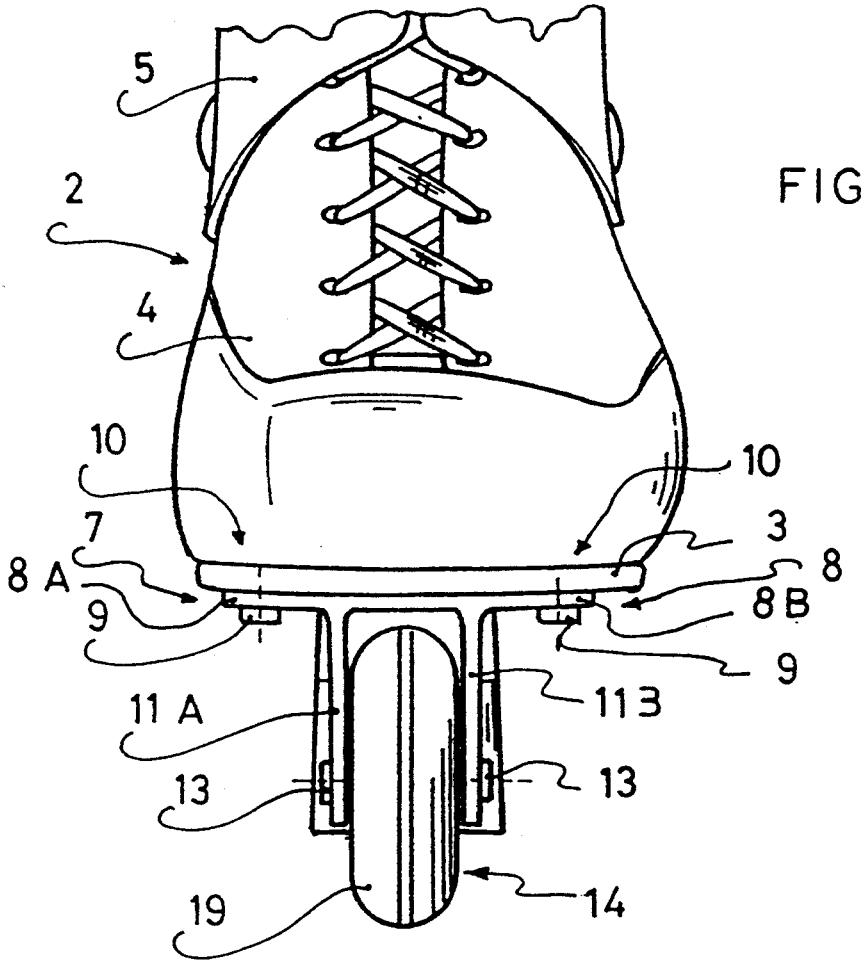
FIG. 2 is a front view of a skate in accordance with FIG. 1.

The skate with in-line wheels 1 shown in its entirety and represented by FIGS. 1 and 2 includes a shoe 2 which consists of a sole 3 surmounted by a lower part of the upper 4 that extends into a shank 5 and an open end into which the foot of the skater is inserted. The shank 5 includes fasteners 6.

The shoe 2 is the same type as that used in cross-country skiing, in which a skater's stride, that is, gliding as in skating, is employed. Indeed, the technical criteria required for optimum support of the foot are noticeably the same in these two sports.

Since such a shoe is known in the art, it has not been described in any further detail here.

The sole 3 of the shoe 2 is solidly joined to a chassis 7 formed by an upper horizontal plate 8, to which said sole 3 is fixed by fasteners, in this case screws 9 passing through the plate 8 in order to screw into the lateral edges 10 of the sole 3.

The chassis 7 also has a lower part 11 perpendicular to the plate 8 along its longitudinal axis.

This lower part includes two lateral vertical flanges 11A, 11B parallel to one another and disposed along both sides of the longitudinal axis.

The lateral flanges 11A and 11B each extend at their upper ends into a perpendicular return 8A and 8B, each one pointing toward the outside, and constituting a plane corresponding to the horizontal plate 8.

In this manner the vertical flanges 11A and 11B, along with the sole 3 of the shoe 2, generally define an inverted U between whose flanges a number of wheels 14, here numbering four, are disposed by means of transverse axles 13, solidly joined to the chassis 7, constituting a rolling train.

The main purpose of openings 16 is to lighten the structure of the chassis 7 described above.

Figure 3:
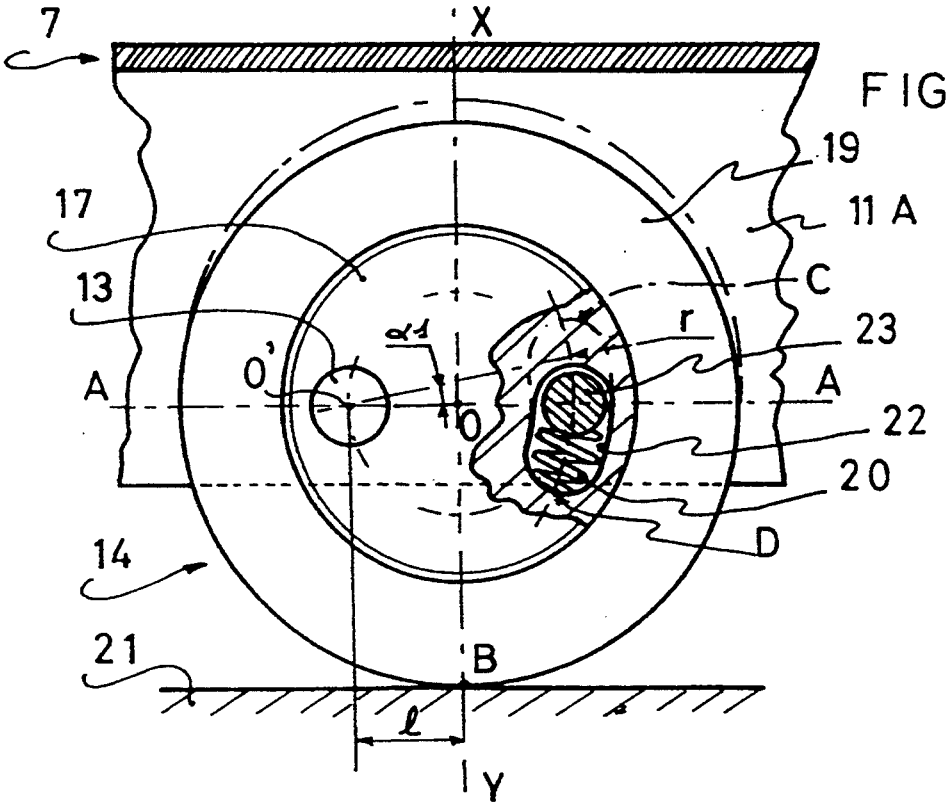
FIG. 3 is a lateral view of a skate wheel, in large scale with a partial cutaway, according to a first embodiment of the invention.

As shown in FIG. 3, the wheel 14 includes a hub 17 disposed on the axle 13 and capable of only limited movement of rotation or angular deflection in relation to this axle. Resting on this hub is a ball bearing 18 (see FIG. 5), interpolated between the hub 17 and an elastic envelope 19 constituting a tire. By means of the ball bearing 18, the tire 19 rotates about hub 17 within a generally vertical plane extending through the center of FIG. 5.

According to the invention, the hub 17 of the wheel 14 is equipped with means which allow its angular deflection in relation to its median horizontal plane A—A, along a predetermined angle $\alpha 1$ and counter to an elastic recoil device 20, so as to constitute a vibration-absorbing device, interpolated between the tire of the wheel 14 and the chassis 7 of the skate.

More precisely, the transverse axle 13 is moved horizontally off-center by a value "1" relative to the virtual center O of the wheel 14, hence in relation to its support point B on the ground 21. This allows for the angular deflection of the hub 17 between limits C,D, determined by the ends of an oblong slot 22 arranged radially along radius "r" in relation to the center O of the axle 13.

The slot 22 is capable, at its ends C, D of cooperating by abutment with a fixed axle 23 solidly joined to the chassis 7, which passes through the slot, and the elastic recoil device 20 rests on this axle 23.

In the same embodiment, the elastic recoil device 20 is inserted under pressure between the supporting axle 23 in an abutting position with the upper end C of the radial slot 22, at rest, and the lower end D opposite it.

It must be noted that the radial slot 22 is arranged generally in a sector of the hub 17, situated in relation to the axle 13, beyond a diametric vertical line X-Y passing through the virtual center O of the wheel 14.

In the same example, the axle 13 of the hub 17 and the supporting axle 23 of the spring 20 are situated along the same horizontal line A—A at an equal distance from the virtual center O of the wheel 14.

The elastic recoil device 20 is constituted here by a helical compression spring.

Figure 4:
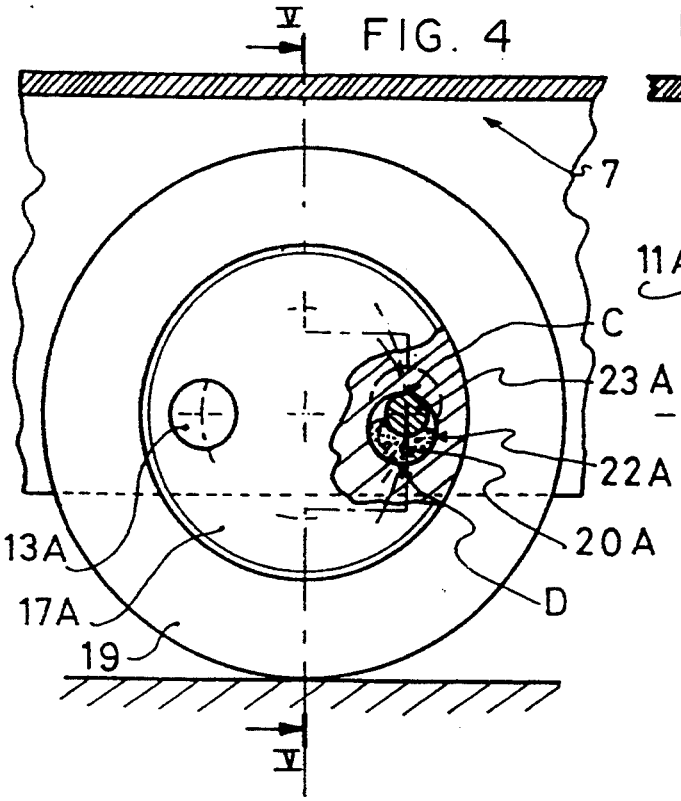
FIG. 4 is a lateral view of a skate wheel, in large scale, according to a second embodiment of the invention.
Figure 5:
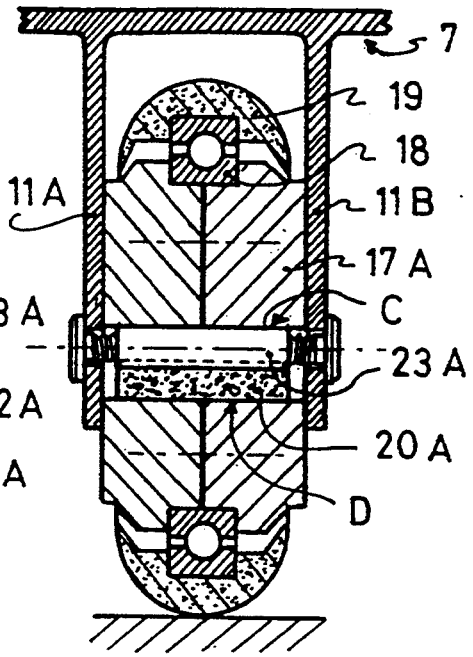
FIG. 5 is a view in section along the dotted line V—V shown in FIG. 4.

The embodiment represented in FIGS. 4 and 5 differs essentially from the preceding example in that the wheel 14A is constituted by a hub 17A and an envelope 19 covering a bearing 18, which consists of an off-center axle 13A in relation to which the slot 22A is angularly articulated counter to an elastic recoil device 20A consisting of a block of compressible material, in this case rubber, housed between the lower end D of the slot 22A and the supporting axle 23A.

Figure 6:
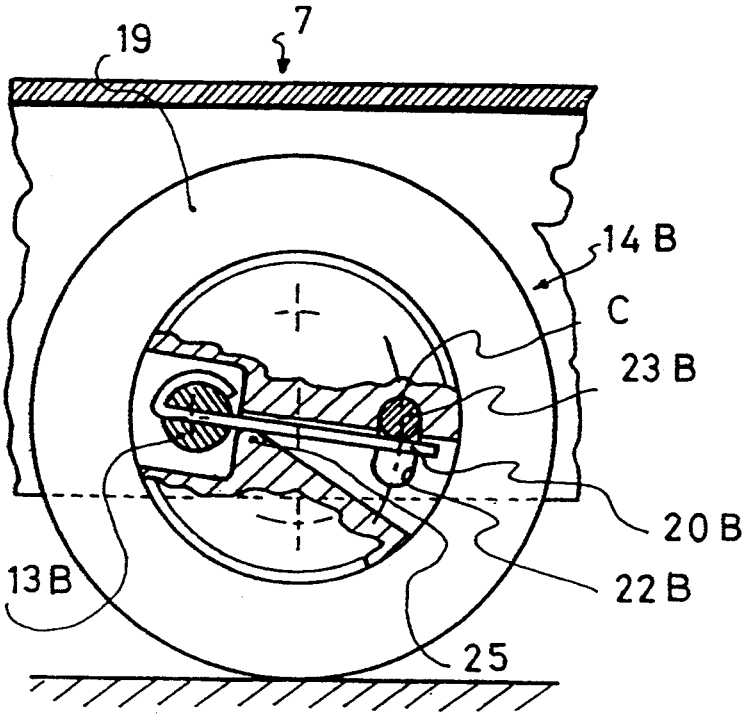
FIG. 6 is a lateral view of a skate wheel, in large scale, according to a third embodiment of the invention.

The embodiment represented in FIG. 6 differs essentially from the preceding examples in that the wheel 14B, which is constituted by the hub 17B and the envelope 19, covering the bearing 18, which has an off-center axle 13B in relation to which the slot 22B is angularly articulated counter to an elastic device constituted by a spring lever 20B interpolated between the supporting axle 23B in abutment with the upper end C of the radial slot 22B, at rest, and a fixed part 25 of the hub 17B on which the spring lever 20B can brace itself.

In this case, the spring lever 20B originates from the axle 13B of the hub 17B arriving at its free end 20C under part of the supporting axle 23B, and emerging through the radial slot 22B.

It must be noted that the shock-absorbing properties of the elastic recoil device 20, 20A, 20B are determined independently for each wheel 14, 14A, 14B depending upon its position under the chassis 7 and the criteria for usage of the skate.

Thus a more significant spring pressure exerted on the front and rear wheels of the skate makes the skate more stable, while such a pressure exerted on the central wheels renders them more maneuverable.

Likewise, a rigid suspension improves performance on a good pavement.

On the other hand, a beginner will have ease of use, and better comfort, with a flexible suspension.

Moreover, since the vibrations are now filtered, the material of the tires no longer has to integrate the parameters of comfort, which can be restrictive, but can instead be developed solely with a view to the desired criteria of performance.

The instant application is based upon French patent application 92.07148 of Jun. 9, 1992, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A skate having in-line wheels, said skate comprising:

a shoe having a sole;

a chassis including an upper generally horizontally disposed plate and a downwardly extending part having at least one lateral flange;

means for fastening said sole to said chassis;

a plurality of wheels, each of said plurality of wheels including a hub, a tire surrounding said hub and a bearing interpolated between said tire and said hub for enabling relative rotation between said tire and said hub in a vertical plane of rotation, a respective transverse axle extending through each said hub for joining a respective one of said plurality of wheels to said lateral flange to thereby constitute a roller train, each said axle extending along an axis horizontally offset relative to a central axis of each said hub, each said hub comprising an arrangement for enabling a predeterminate amount of guided angular deflection of said hub in said vertical plane of rotation with respect to a horizontal plane and each said hub further comprising an elastic recoil device for absorbing vibrations between said tire and said chassis as said hub is angularly deflected.

2. A skate as defined in claim 1, wherein:

each said bearing comprises a ball bearing arrangement surrounding said hub, said tire surrounding said ball bearing arrangement.

3. A skate as defined in claim 1, wherein:

each said elastic recoil device comprises a helical compression spring.

4. A skate as defined in claim 1, wherein:

each said elastic recoil device comprises a quantity of compressible material.

5. A skate as defined in claim 4, wherein:

said compressible material comprises rubber.

6. A skate as defined in claim 1, wherein:
each of said plurality of wheels is positioned in a respective unique location with respect to said chassis; and
each said elastic recoil device comprises means for providing shock-absorbing properties as a function of said location of each of said plurality of wheels and as a function of a use criteria for said skate.

7. A skate having in-line wheels, said skate comprising:
a shoe having a sole;
a chassis including an upper generally horizontally disposed plate and a downwardly extending part having at least one lateral flange;
means for fastening said sole to said chassis;
a plurality of wheels, each of said plurality of wheels including a hub, a tire surrounding said hub and a bearing interpolated between said tire and said hub for enabling relative rotation between said tire and said hub, a respective transverse axle extending through each said hub for joining a respective one of said plurality of wheels to said lateral flange to thereby constitute a roller train, each said hub comprising an arrangement for enabling a predeterminate amount of angular deflection of said hub with respect to a horizontal plane and each said hub further comprising an elastic recoil device for absorbing vibrations between said tire and said chassis as said hub is angularly deflected;
each said wheel comprising a central axis and each said axle extending along an axis horizontally offset relative to said central axis;
each said hub further comprising an oblong slot extending along an arc of a radius emanating from said offset axis, said oblong slot having opposite ends; and
each said elastic recoil device being positioned within said oblong slot.

8. A skate as defined in claim 7, wherein:
each said elastic recoil device further comprises an axle fixed in position with respect to said chassis and extending within said oblong slot and, in a rest position, said fixed axle is positioned in abutment against one of said opposite ends of said oblong slot; and
each said elastic recoil device further comprises an elastic element being positioned in compression between said fixed axle and another of said opposite ends of said oblong slot.

9. A skate as defined in claim 8, wherein:
each said transverse axle of said plurality of wheels is positioned on a first side of a transverse diametrical vertical plane passing through said central axis of said wheel; and
each said oblong slot being positioned on a second side of said transverse diametrical vertical plane.

10. A skate as defined in claim 9, wherein:
each said transverse axle and each said fixed axle of each respective wheel are positioned on a common generally horizontal plane and are spaced at a substantially equal distance from said central axis of said wheel.

11. A skate as defined in claim 8, wherein:
each said transverse axle and each said fixed axle of each respective wheel are positioned on a common generally horizontal plane and are spaced at a substantially equal distance from said central axis of said wheel.

12. A skate as defined in claim 8, wherein:
each said elastic recoil device comprises a helical compression spring.

13. A skate as defined in claim 8, wherein:
each said elastic recoil device comprises a quantity of compressible material.

14. A skate as defined in claim 13, wherein:
said compressible material comprises rubber.

15. A skate as defined in claim 8, wherein:
each said elastic recoil device comprises a spring lever interpolated between said fixed axle and one of said opposite ends of said oblong slot.

16. A skate as defined in claim 15, wherein:
each said spring lever is fixed to said transverse axle and extends from said transverse axle to a position adjacent said fixed axle.

17. A skate as defined in claim 7, wherein:
each said transverse axle of said plurality of wheels is positioned on a first side of a transverse diametrical vertical plane passing through said central axis of said wheel; and
each said oblong slot being positioned on a second side of said transverse diametrical vertical plane.

18. A skate as defined in claim 17, wherein:
each said transverse axle and each said fixed axle of each respective wheel are positioned on a common generally horizontal plane and are spaced at a substantially equal distance from said central axis of said wheel.

19. A skate as defined in claim 7, wherein:
each said elastic recoil device comprises a helical compression spring.

20. A skate as defined in claim 7, wherein:
each said elastic recoil device comprises a quantity of compressible material.

21. A skate as defined in claim 20, wherein:
said compressible material comprises rubber.

22. An apparatus comprising:
a skate wheel, a support for said skate wheel and with respect to which said skate wheel rotates, and a shock-absorbing arrangement interpolated between said skate wheel and said support;
said skate wheel comprising:
a hub;
a tire surrounding said hub;
a bearing interpolated between said tire and said hub for enabling relative rotation between said tire and said hub in a vertical plane of rotation;
a transverse axle extending through said hub, thereby joining said skate wheel to said support, said axle extending along an axis horizontally offset relative to a central axis of said hub; and
means for enabling a predeterminate amount of angular deflection of said hub with respect to a horizontal plane within said vertical plane of rotation; and
said shock-absorbing arrangement comprising an elastic recoil device for absorbing vibrations between said tire and said support as said hub is angularly deflected.

23. An apparatus comprising:
a skate wheel, a support for said skate wheel and with respect to which said skate wheel rotates, and a shock-absorbing arrangement interpolated between said skate wheel and said support;
said skate wheel comprising:
a hub;
a tire surrounding said hub;

a bearing interpolated between said tire and said hub for enabling relative rotation between said tire and said hub;

a transverse axle extending through said hub, thereby joining said skate wheel to said support; and means for enabling a predeterminate amount of angular deflection of said hub with respect to a horizontal plane;

said shock-absorbing arrangement comprising an elastic recoil device for absorbing vibrations between said tire and said support as said hub is angularly deflected;

said skate wheel comprising a central axis and said axle extending along an axis horizontally offset relative to said central axis;

said hub further comprising an oblong slot extending along an arc of a radius emanating from said offset axis, said oblong slot having opposite ends; and said elastic recoil device being positioned within said oblong slot.

24. An apparatus as defined in claim 23, wherein:

said elastic recoil device further comprises an axle fixed in position with respect to said support and extending within said oblong slot and, in a rest position, said fixed axle is positioned in abutment against one of said opposite ends of said oblong slot; and said elastic recoil device further comprises an elastic element being positioned in compression between said fixed axle and another of said opposite ends of said oblong slot.

* * * * *